US005896802A

United States Patent [19]

Hass et al.

[11] Patent Number: 5,896,802

[45] Date of Patent: Apr. 27, 1999

[54] ROTATING APPARATUS FOR A DIESEL MOTOR

[75] Inventors: Rudiger Hass; Helmut Burger; Pay Brodersen; Hartmut Bartel; Per Bork, all of Kiel, Germany

[73] Assignee: MaK Motren GmbH, Kiel, Germany

[21] Appl. No.: 08/933,355

[22] Filed: Sep. 18, 1997

[30] Foreign Application Priority Data

Sep. 26, 1996 [DE] Germany ..... 196 39 505

[51] Int. Cl.[6] ..... F01B 25/26; F15B 21/02; F01L 15/00

[52] U.S. Cl. ..... 91/1; 91/40; 91/192; 91/194

[58] Field of Search ..... 91/1, 36, 39, 40, 91/171, 183, 187, 189 R, 190, 191, 192, 193, 194, 195, 410

[56] References Cited

U.S. PATENT DOCUMENTS

| | | | |
|---|---|---|---|
| 3,424,059 | 1/1969 | Conner et al. | 91/183 X |
| 3,661,059 | 5/1972 | Hunter et al. | 91/192 X |
| 3,848,515 | 11/1974 | Gardineer et al. | 91/192 X |
| 4,503,751 | 3/1985 | Pinson | 91/40 X |
| 4,793,241 | 12/1988 | Mano et al. | 91/1 X |
| 4,898,075 | 2/1990 | Horsch | 91/193 X |
| 5,657,681 | 8/1997 | Henricson | 91/472 |

*Primary Examiner*—John E. Ryznic
*Attorney, Agent, or Firm*—Alan J. Hickman

[57] ABSTRACT

A rotating device for a diesel motor comprises a unit having a plurality of pneumatic cylinders that can be brought into mating engagement with teeth on a flywheel of the motor. Each pneumatic cylinder, under the control of a control unit, is actuated and sequentially pushed into the teeth such that a counter-clockwise or clockwise rotation is possible.

6 Claims, 1 Drawing Sheet

ROTATING APPARATUS FOR A DIESEL MOTOR

TECHNICAL FIELD

This invention relates generally to a rotating device which sets motor parameters for a diesel motor and more particularly to a rotating device acting on a flywheel of the motor.

BACKGROUND ART

For the setting of motor parameters, i.e., for assembly and during repairs, of relatively large diesel motors, it is known to use a rotating device. They are driven electrically and include step-down gearing and a rotation process carried out by means of a worm or tooth-wheel drive.

The present invention provides a rotating device for a diesel motor that consists of a structural unit that is unaffected by vibration and can be connected in a simple fashion as a functional unit to the cylinder housing.

DISCLOSURE OF THE INVENTION

In one aspect of the present invention, a rotating device for setting motor parameters of a diesel motor by acting upon a flywheel of the motor is provided. The rotating device has plurality of pneumatic cylinders each having a piston facing the flywheel. A plurality of spaced teeth are connected to the flywheel of said motor. A control unit has a manual controller and a plurality of control valves connected to the pneumatic cylinders. The pneumatic cylinders are stepwise actuatable in response to sequential actuation of the control valves. The pistons are selectively engageable and disengagable with the teeth and rotate the flywheel in response to stepwise actuation of the pneumatic cylinders.

The advantages primarily achieved by the invention are mainly in the fact that teeth are cast onto the motor flywheel, meshing with adjusting elements of pneumatic cylinders, whereby the adjusting elements are provided with pistons having punch like heads in the shape of a frustum of a cone. The cylinders are connected to a control unit, which controls the pneumatic cylinders sequentially in such a way that the flywheel can be turned to the right or to the left (clockwise or counter-clockwise). An initial adjustment is made by way of a manual switch, which makes the first setting of each pneumatic cylinder.

The pneumatic cylinders as well as the control unit and the manual control unit are constructed in a manner so as to provide a unit that is relatively flat compact design that requires a minimal amount of space. The structural unit is mounted on the cylinder crank housing. The structural unit is non-sensitive to vibrations.

The pneumatic cylinders are sequentially linearly displaced (positioned, adjusted) such that a rotation of the flywheel is effected. Limit switches are provided so that the cylinders can be exactly sequentially engaged and disengaged from mating with the teeth. These limit switches pass on the particular end position of the pneumatic cylinder to the control unit which then effects corresponding controlling of the pneumatic cylinders via the valves. Thus, an exact adjustment position of the pneumatic cylinders is achieved in an advantageous manner and the cylinders are engaged in the toothing sequentially to effect a rotation of the flywheel.

At the beginning of the start-up process, if a piston hits the toothing at its end face (side), the starting cylinder is changed by a limit switch. Subsequently, the adjacent neighboring pneumatic cylinder is actuated to initiate rotation of the flywheel.

The pneumatic cylinders are controlled such that all three pneumatic cylinders are needed to determine the direction of rotation. The sequential order of engagement dictates the direction of rotation. Thus, rotation of the flywheel to the left or right can be achieved.

BEST MODE FOR CARRYING OUT THE INVENTION

Figure 1:
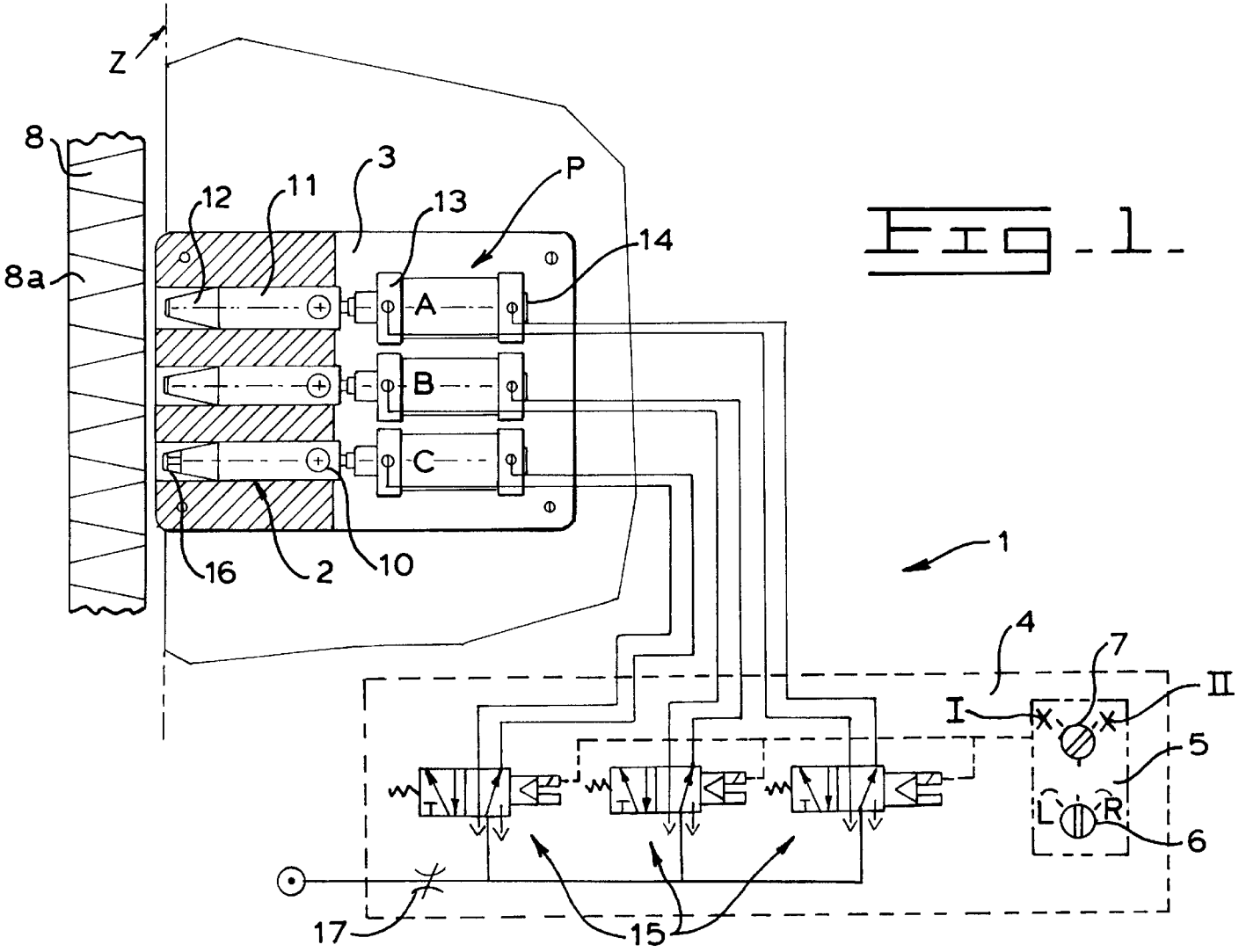
FIG. 1, is a diagrammatic sole figure of an embodiment of the present invention, showing a functional schematic of a rotary device with pneumatic cylinders and a control device.

The rotating device 1 comprises a unit P of pneumatic cylinders A, B and C, whose pistons 11 are guided in bore holes 2 of a cast block 3. A control unit 4 as well as a manual control unit 5 with switches 6 and 7 is connected with the pneumatic cylinders A, B and C via wiring. These are controllable and for rotating a flywheel in engagement with a teeth 8 joined to the flywheel by casting. A manual control switch 7 serves for switching on and off in the positions I and II. Furthermore, switch 6 serves for initiating the left and right (counter-clockwise and clockwise) rotation. This switch 6 can be set in the position L for counter-clockwise rotation and R for clockwise rotation in addition to a zero position which stops the rotation.

The truncated cone-shaped punch like heads 12 of pistons 11 of the pneumatic cylinders A, B and C are forced in sequentially and individually between teeth spaces 8*a* of the teeth 8. This causes the flywheel to rotate. This rotation is achieved in accordance with the principle of an inclined plane. In order to effect a turning, the division of the teeth 8 is different from the distances of the heads 12 of the pneumatic cylinders A, B and C. With an engagement of the head 12 of the pneumatic cylinder A, the head 12 of the pneumatic cylinder A pushes against a tooth face surface of the teeth 8 and rotates the gear and thus the flywheel accordingly.

The pneumatic rotating device 1, also called a turning device quasi corresponds to for example, a step motor that consists of three pneumatic cylinders A, B and C facing both sides. The pistons 11 are connected with the cylinders via couplings 10. The truncated cone-shaped heads 12 are located on the front ends of the pistons 11, respectively. The heads 12 are oriented towards the toothing 8, i.e., the bevelled surfaces of the heads seen in the protection are oriented towards the bevelled surfaces of the teeth 8.

A controlling of the rotation is carried out via end or limit switches 13, 14. The limit switches electrically or pneumatically actuates a 4/2-way valve 15 upon reaching the particular end limit position, thus triggering the displacement procedure (shifting operation) for the next pneumatic cylinder.

Furthermore, the end limit position switches 16 are provided on the front faces of the heads 12 so that when the head 12 hits a tooth 8 on the front surface (end plane of the tooth) the limit position switch is switched on. This causes actuation of the next pneumatic cylinder.

The counter-clockwise or clockwise direction of rotation is predetermined by the actuating switch 6. A corresponding responsive actuation of the three pneumatic cylinders A, B and C is under the control of the control unit 4 and carried out by way of the valves 15. The direction of rotation in the counter-clockwise direction is carried out via the sequence of actuation first via the pneumatic cylinder A, then via B and then by C. The direction of rotation in the clockwise direction is first carried out in the sequence via the actuation of the pneumatic cylinder C, then via B and then by A. The speed of the rotation of the flywheel is predetermined and established by the throttling valve 17. Stopping of the procedure causing rotation of the flywheel is carried out by way of manual actuation of the switch 7 and the resulting responsive actuation of the 4/2 way valve.

Other aspects, objects and advantages of this invention can be obtained from a study of the drawings, the disclosure and the appended claims.

We claim:

1. A rotating device for setting motor parameters of a diesel motor by acting upon a flywheel of the motor, comprising:

a plurality of pneumatic cylinders each having a piston, said pistons facing the flywheel;

a plurality of spaced teeth connected to the flywheel of said motor, said pistons each having a cone-shaped piston head and said teeth each having beveled transversely oriented surfaces, said cone shaped piston heads being oriented in a transverse direction relative to the flywheel, said cone shaped piston heads being sequentially engagable with the cone shaped surfaces of teeth in response to transverse movement of the cone shaped piston heads between the teeth;

a control unit having a manual controller and a plurality of control valves connected to said pneumatic cylinders, said pneumatic cylinders being stepwise actuatable in response to sequential actuation of said control valves, said pistons being selectively engageable and disengagable with said teeth and rotating said flywheel in response to stepwise actuation of said pneumatic cylinders.

2. The rotating device, according to claim 1, wherein said flywheel being rotatable in a clockwise and a counterclockwise direction and wherein said plurality of pneumatic cylinders include a first pneumatic cylinder, a second pneumatic cylinder and a third pneumatic cylinder, said first, second and third pneumatic cylinders being sequentially positioned and controllably actuatable, said flywheel being rotatable in a counter-clockwise direction in response to a sequential actuation of said pneumatic cylinders beginning with said first pneumatic cylinder and ending with said third pneumatic cylinder and in the clockwise direction in response to sequential actuation of said pneumatic cylinders beginning with said third pneumatic cylinder and ending with said first pneumatic cylinder.

3. The rotating device, according to claim 2, including a plurality of limit switches connected to the piston heads of said pneumatic cylinders, said limit switches sensing an engaged and a disengaged end position of said pneumatic cylinders, said control unit sequentially engagably and disengagably controlling actuation of the pneumatic cylinders in response to limit switch sensing.

4. A rotating device for setting motor parameters of a diesel motor by acting upon a flywheel of the motor, comprising:

a plurality of pneumatic cylinders each having a piston, and a piston head having a frontal end, said pistons facing the flywheel;

a plurality of spaced teeth connected to the flywheel of said motor;

a control unit having a manual controller and a plurality of control valves connected to said pneumatic cylinders, said pneumatic cylinders being stepwise actuatable in response to sequential actuation of said control valves, said pistons being selectively engageable and disengagable with said teeth and rotating said flywheel in response to stepwise actuation of said pneumatic cylinders, said flywheel being rotatable in a clockwise and a counterclockwise direction and said plurality of pneumatic cylinders including a first pneumatic cylinder, a second pneumatic cylinder and a third pneumatic cylinder, said first, second and third pneumatic cylinders being sequentially positioned and controllably actuatable, said flywheel being rotatable in a counter-clockwise direction in response to a sequential actuation of said pneumatic cylinders beginning with said first pneumatic cylinder and ending with said third pneumatic cylinder and in the clockwise direction in response to sequential actuation of said pneumatic cylinders beginning with said third pneumatic cylinder and ending with said first pneumatic cylinder; and a plurality of limit switches connected to the frontal end of the piston heads of said pneumatic cylinders, said limit switches sensing an engaged and a disengaged end position of said pneumatic cylinders, said control unit sequentially engagably and disengagably controlling actuation of the pneumatic cylinders in response to limit switch sensing, a next one of the first, second and third pneumatic cylinders in sequence being actuatable in response to a predetermined limit switch sensing process.

5. The rotating device, according to claim 4, herein said first, second and third pneumatic cylinders being connected to a cast block having a plurality of guide bore holes disposed therein, said pistons being slidably disposed in the guide bores and said cast block being fixable to a cylinder housing of said motor.

6. The rotating device, according to claim 5, wherein said plurality of control valves include three 4/2 way valves connected to each other and combined with said control unit including, said manual controller, pistons and said cast block to form a premountable structural unit.

* * * * *